US005949005A

United States Patent [19]

Peterson

[11] Patent Number: 5,949,005

[45] **Date of Patent: *Sep. 7, 1999**

[54] COLLAPSIBLE GUITAR KIT

[76] Inventor: Dale Peterson, 7875 Sunset Hill La., Sunset Hills, Calif. 95843

[ * ] Notice: This patent issued on a continued prosecution application filed under 37 CFR 1.53(d), and is subject to the twenty year patent term provisions of 35 U.S.C. 154(a)(2).

[21] Appl. No.: 08/659,487

[22] Filed: Jun. 6, 1996

[51] Int. Cl.[6] ..... G10D 3/00

[52] U.S. Cl. ..... 84/291; 84/293; 84/267

[58] Field of Search ..... 84/291, 293, 267

[56] References Cited

U.S. PATENT DOCUMENTS 4,638,708 1/1987 Kamal ..... 84/293

5,353,672 10/1994 Stewart .

*Primary Examiner*—William M. Shoop, Jr.

*Assistant Examiner*—Shih-yung Hseih

*Attorney, Agent, or Firm*—John P. O'Banion

[57] ABSTRACT

A collapsible guitar kit designed to modify existing guitars so that guitar necks can be separated from guitar bodies for compact storage and for convenient interchanging of varying guitar necks with varying guitar bodies. The invention includes a neck plate, a body plate and a backing plate. The neck plate is provided to attach to a guitar neck. The body plate is provided to attach to a guitar body, and a backing plate is provided to attach to the underside of a guitar body. The neck plate and body plate provide a precision fit to each other by means of tooling points, while the backing plate provides consistent realignment and securing of both neck and body plates by means of a single bolt. The entire assembly is economical to manufacture and provides users the ability to modify any existing guitar to become collapsible for compact storage or for interchanging of various guitar necks with various guitar bodies.

18 Claims, 3 Drawing Sheets

COLLAPSIBLE GUITAR KIT

FIELD OF INVENTION

The present invention relates to stringed musical instruments (SMI) and more specifically to guitars which can be modified to collapse for ease of compact storage and transport. Stringed musical instruments that are modified with the methods and parts taught by the present invention can be easily collapsed to compact sizes that favor the discrete and convenient storage and transport needs of many SMI owners and users. The present invention also allows brand name or custom guitars to be interchanged. For example, a Fender brand guitar neck can be applied to a Gibson brand guitar body. This ability to interchange guitars will allow the users to inexpensively create custom guitars of their choice.

BACKGROUND OF THE INVENTION

The need for making a stringed musical instrument compact in size for storage and travel has led to several inventions. Representative of the prior art are Jorgensen U.S. Pat. No. (4,073,211), Litwin U.S. Pat. No. (4,191,085), Fishman U.S. Pat. No. (4,911,057), Hoshino U.S. Pat. No. (4,939,970), and Stewart U.S. Pat. No. (5,353,672). Stewart defines well the shortcomings of the above listed prior art and teaches a collapsible guitar with a quick disconnect neck and submerged string tunnels. The invention of Stewart provides an entire guitar unit that is manufactured as collapsible. Unlike Stewart's, the present invention teaches a collapsible kit assembly that can modify any existing guitar, therefore musicians are allowed to modify their favorite instruments to make them collapsible and interchangeable with brand name guitars, and are not limited to the particular design or make of Stewart's. Stewart also teaches a neck plate assembly that functions with rail alignments. The present invention provides a neck and body plate assembly that incorporates tooling dowels and slip fit which provide for greater realignment accuracy of an SMI neck to an SMI body. Lastly, Stewart teaches a guitar that has both a cavity for storing the releasable guitar neck, and a plurality of string tunnels formed within said guitar body for eliminating the need for retuning after collapsing said guitar. Thus, Stewart's invention is clearly not designed for modifying existing guitars, rather it is a method for manufacturing new guitars or SMI units. The present invention is not near as complex as Stewart's, and provides a simple tension rack that is easily assembled and allows the user to maintain loosened guitar strings while folding a guitar neck over the guitar body to make it collapsible and compact.

SUMMARY OF THE INVENTION

The present invention is a collapsible kit designed to modify existing stringed musical instruments. Unlike the inventions of the prior art which teach collapsible guitars that are manufactured as such, the present invention is a method or kit, which can be assembled to any typically non-collapsible manufactured guitar. Stringed musical instruments modified with the present invention can be easily collapsed to compact size and made interchangeable without necessity for special tools or skills.

The features of the present invention that allow existing stringed musical instruments to be made collapsible are a neck plate, a body plate, and a backing plate. Each plate corresponds to each other in dimensions and alignment of assembly openings. The guitar must initially be taken to a machine shop for milling a slot in the underside end of the guitar neck, and also to mill a corresponding cavity to the end of the guitar body. With the guitar neck slot and cavity appropriately milled, the plate assembly kit can be easily attached with glue and a screwdriver.

The neck plate is to be permanently attached to the underside of a guitar neck, while the body plate is to be permanently attached to the end of a guitar body. The neck plate and body plate assemble together with corresponding tooling dowels and openings, and thereby provide reassembly of guitar neck to guitar body. To provide consistent and secure attachment of guitar neck with guitar body, a backing plate is provided on the underside of guitar body directly under the body plate. A hex bolt is threaded through the backing plate, the body plate and the neck plate, thereby aligning all three assembly plates and providing secure attachment.

With the collapsible guitar kit assembled, the neck of a guitar can be removed from the body by loosening the guitar strings, removing the hex bolt from all three plates, lifting the neck portion from body plate, and folding the neck over so that it rests on the top surface of the guitar body. A tension rack assembly designed to keep the guitar strings taut against the guitar neck is also provided. To reassemble the guitar neck to the guitar body, simply fold neck back away from the guitar body, align and insert tooling dowels of body plate into openings of neck plate, insert and thread hex bolt through all plate members, and then retune guitar strings.

A principle object of the present invention is to provide a collapsible assembly kit that can be added to any existing stringed musical instrument.

Another object of the present invention is to provide an economical means of converting a non-collapsible stringed musical instrument into a collapsible one.

Another object of the present invention is to provide a method for converting noncollapsible stringed musical instruments into collapsible ones that does not require unusual dexterity or any special skills or tools to assemble and disassemble.

Another object of the present invention is to allow existing brand name guitars to be made interchangeable with eachother so that a specific guitar body can be attached to a specific guitar neck.

BRIEF DESCRIPTION OF THE DRAWINGS

These and other aspects of the invention are apparent from the following drawings, in which.

DETAILED DESCRIPTION OF THE INVENTION

It should be noted that while a guitar is shown and described, this invention is applicable to all stringed musical instruments.

Figure 1:
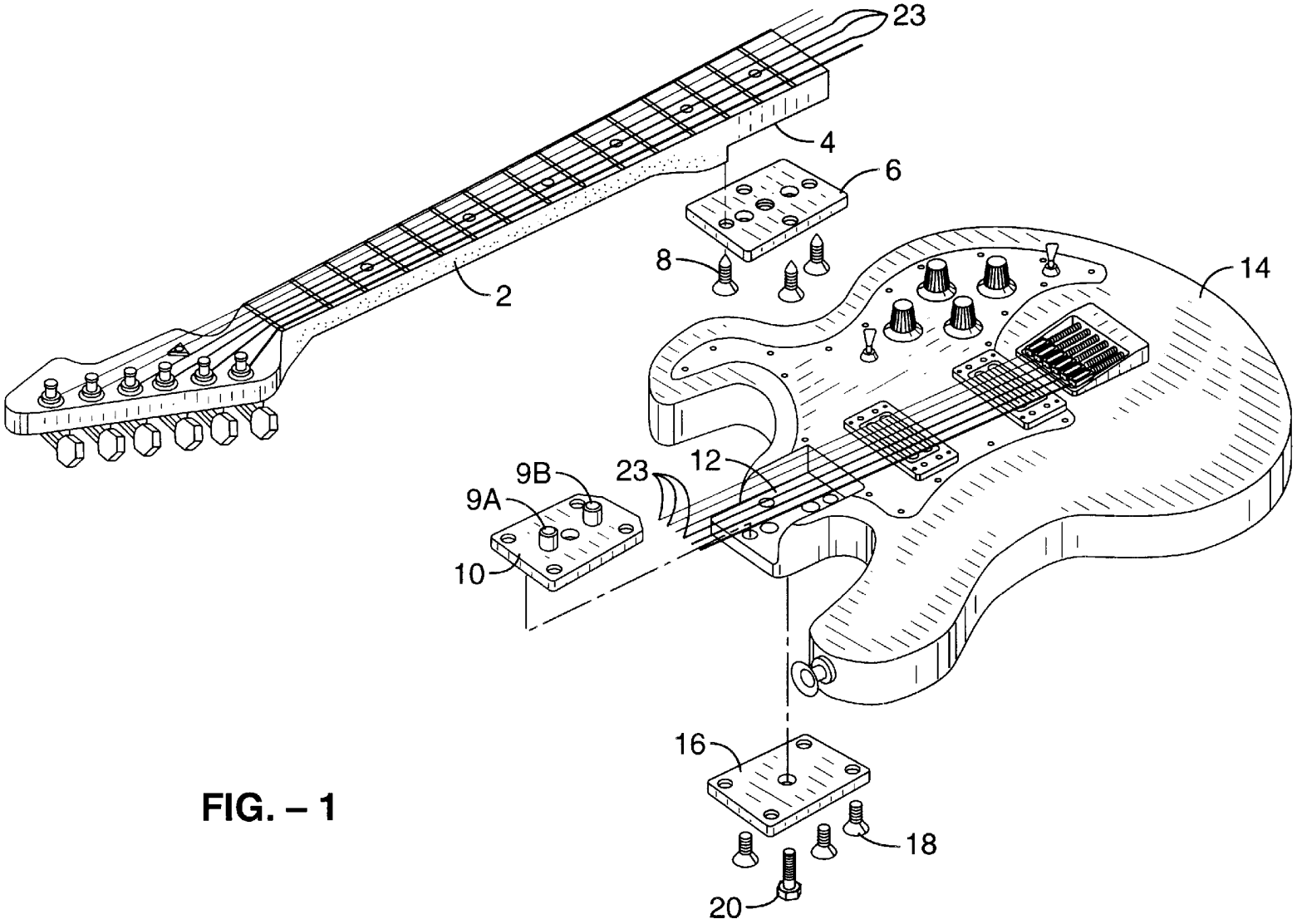
FIG. 1 shows a perspective top view of the present invention.
Figure 2:
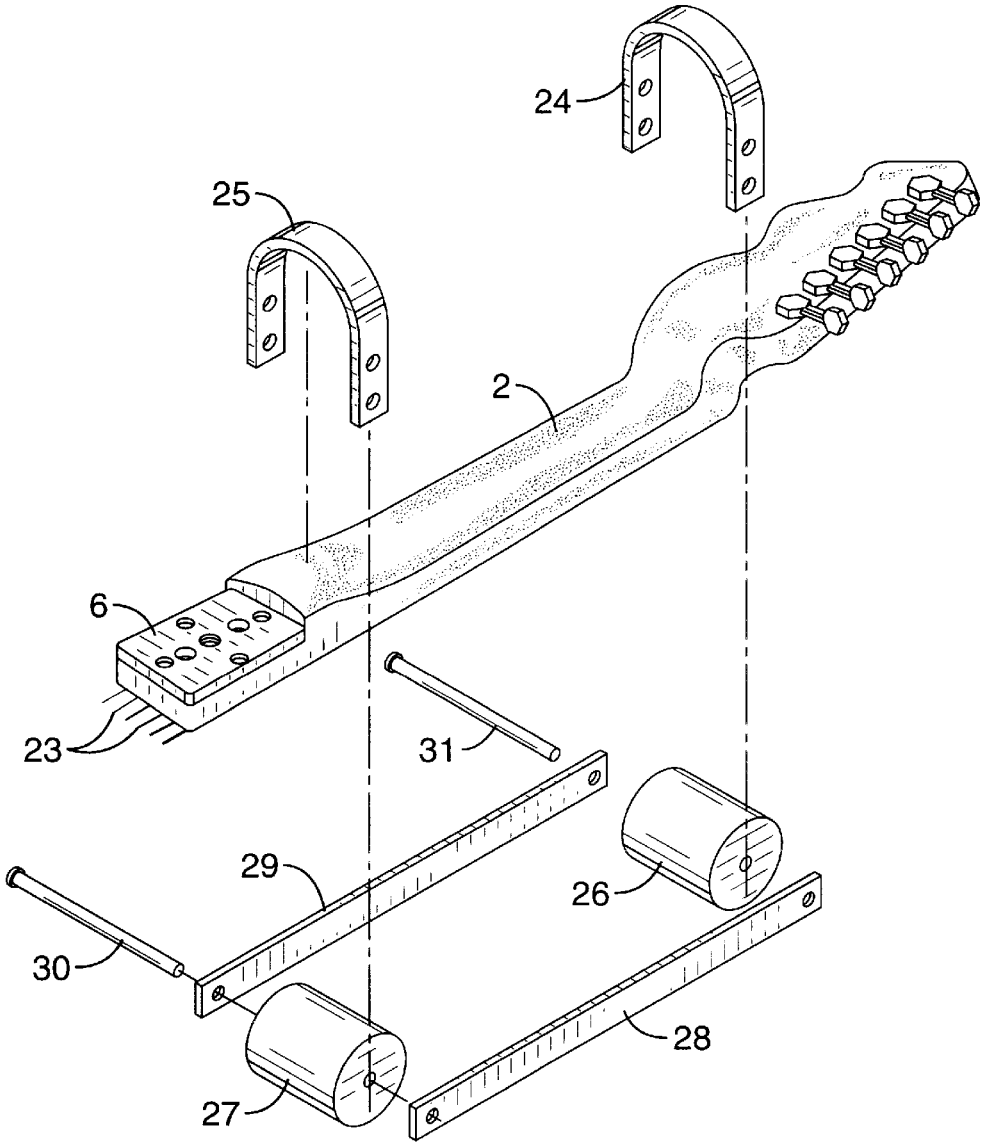
FIG. 2 shows a perspective top view of the present invention with a storage and transport assembly.
Figure 2:
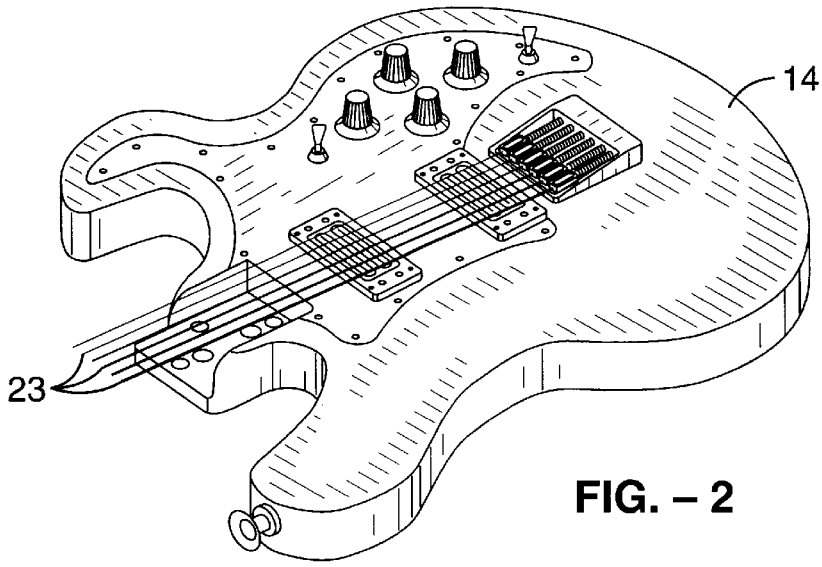

Referring to FIG. 1–2, the present invention provides a guitar body 14, a guitar neck 2, a neck slot 4, a neck plate 6, four wood screws 8, a body plate 10, tooling dowel members 9A and 9B, a cavity 12, a backing plate 16, four flat head machine screws 18, and a hex bolt 20. To initially assemble the guitar of the present invention, remove or loosen the guitar strings. Next, a milling machine is used to produce slot 4 at end of neck section 2 and cavity 12 at end of guitar body 14. Both slot 4 and cavity 12 are milled according to the dimensions of a neck plate 6, a body plate 10 and a back plate 16. Neck plate 6 provides four threaded openings for wood screws, two unthreaded openings for tooling point members, and one threaded opening for a hex bolt. With neck plate 6 centered in slot 4, the four wood screw openings on plate 6 are marked on underside of neck section 2 where plate 6 sits in slot 4. The centers of wood screw openings of plate 6 are transferred to underside surface of neck 2 in slot 4 for exact pre-drilling of four corresponding wood screws. To permanently attach neck plate 6 to neck 2, the underside of neck 2 at slot 4 is pre-drilled for four (4) wood screws. A wood adhesive is then applied to slot 4. Neck plate 6 is then inserted into slot 4, assuring that screw openings of neck plate 6 align with pre-drill holes on neck 2. With plate 6 precisely located in slot 4, the wood screws are threaded through plate 6 and into slot 4 to secure and attach plate 6 to slot 4.

Upon adhesive curing, temporarily attach the body plate 10 to the neck plate assembly. Body plate 10 provides four threaded openings for flat head screws, two upward exteriorly protruding tooling point members, and one threaded opening for a hex bolt. All of the openings on body plate 10 align precisely with the corresponding openings on neck plate 6 and back plate 16. Body plate 10 is temporarily attached to neck plate assembly by inserting the tooling dowels of plate 10 into the openings of neck plate 6. With neck plate 6 and body plate 10 assembled to each other, the backing plate 16 is temporarily placed into the cavity 12 of guitar body 14. Backing plate 16 provides four threaded openings for flat head machine screws, and one opening for a hex bolt. With backing plate 16 placed into cavity 12, the centered locations of all openings on plate 16 are transferred to the interior bottom surface of cavity 12 for exact pre-drilling. Adhesive is then applied to the bottom surface of cavity 12. Neck 2 is then placed into cavity 12 with the neck plate 6 and body plate 10 still assembled. With the flat head screw and hex bolt openings of body plate 10 aligned with the corresponding pre-drilled hole openings in cavity 12, backing plate 16 is placed on the underside of guitar body 14 directly under cavity 12. Backing plate 16 is then attached to body 14 and body plate 10 by installing four flat head machine screws through backing plate 16 and into threaded openings of body plate 10. With neck 2 securely attached to body 14, a hex bolt 20 is inserted through opening provided on underside of backing plate 16 and is securely threaded into opening of neck plate 6. With neck plate 6 permanently attached to neck 2, body plate 10 permanently attached to cavity 12, and backing plate 16 attached to guitar body 14 and body plate 10, hex bolt 20 can be removed to provide constant reassembly attachment of guitar neck 2 to guitar body 14.

To disassemble the guitar of the present invention, loosen guitar strings and then unthread hex bolt 20 from neck plate 6, body plate 10 and backing plate 16. With hex bolt 20 removed, lift and remove neck 2 from body 14. The protruding tooling point members of body plate 10 will slide out of corresponding openings provided on neck plate 6, thereby allowing neck 2 to completely separate from body 14.

Figure 3:
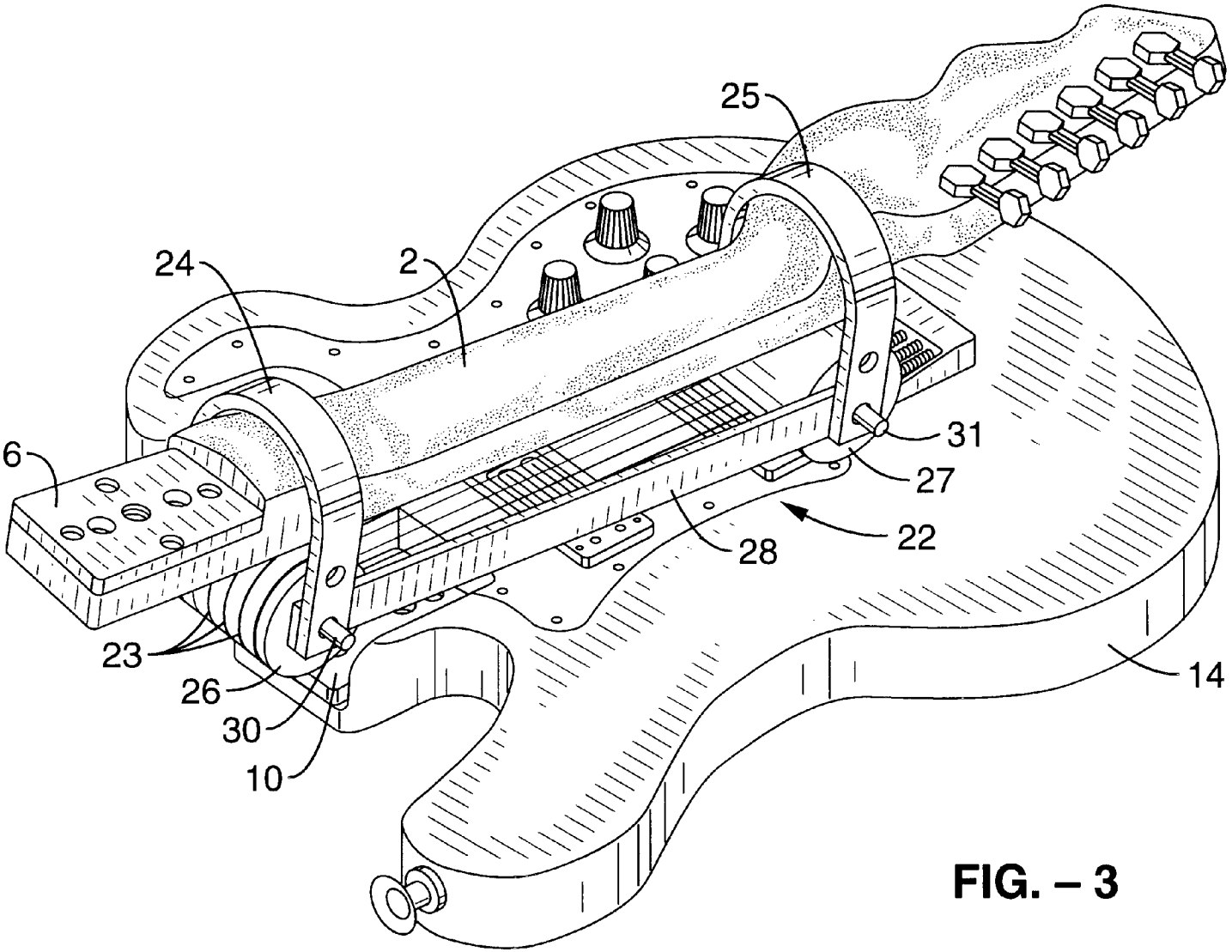
FIG. 3 shows a perspective view of the present invention's tension rack assembly in use.

Referring to FIG. 3, the preferred embodiment of the present invention also provides a tension rack 22 for securing loosened guitar strings to the neck of a guitar utilizing the collapsible kit assembly of the present invention. The tension rack 22 maintains the guitar strings while allowing a guitar neck to be folded over on to the top surface of a guitar body. Tension rack 22 provides two elastic straps 24 and 25, two tension spools 26 and 27, two case hardened straps 28 and 29, and two strap pins 30 and 31. With the guitar strings loosened, the tension spools 26, 27 are placed against guitar strings on neck 2 and assembled to case straps 28, 29 by inserting strap pins 30, 31 through ends of case straps 28, 29 and through tension spools 26, 27. The elastic straps 24, 25 are then placed around neck 2 to attach to opposite ends of pins 30, 31. Elastic straps 24, 25 provide adequate tension to keep tension spools 24, 25 tight against neck 2 and guitar strings respectfully. With tension rack 22 in place, neck 2 can be folded so that The tension spools 24, 25 rest between neck 2 and guitar body 14. Neck 2 can then be secured to body 14 by several means of attachment.

While there is shown and described herein certain specific structures embodying this invention for the purpose of clarity of understanding, the same is to be considered as illustrative in character, it being understood that only the preferred embodiments have been shown and described. It will be manifest to those skilled in the art That certain changes, various modifications and rearrangements of the parts may be made without departing from the spirit and scope of the underlying inventive concept and that the same is not limited to the particular forms herein shown and described except insofar as indicated in the scope of the appended claims.

What is claimed is:

1. A collapsible guitar assembly kit comprising:

(a) a neck plate, said neck plate rigidly attached to a guitar neck;

(b) a body plate, said body plate rigidly attached to a guitar body;

(c) an alignment assembly integrated with said neck plate and said body plate, said assembly including at least one protrusion and at least one corresponding opening sized to mate snugly with said protrusion;

(d) an assembly fastener, said fastener including anchoring means for rigidly and releasably anchoring said neck to said body;

(e) at least two tension spools;

(f) at least two hardened straps, said spools attached to said hardened straps with strap pins, said pins having a first end and a second end; and (g) at least two elastic straps, said elastic straps including at least one aperture at each end, said apertures sized to mate with said pins, said elastic straps releasably engaging said first and said second ends of said pins, said elastic straps sized to maintain said spools against said guitar neck when said elastic straps are positioned around said neck and said elastic straps engage said ends of said pins.

2. A collapsible guitar assembly kit as recited in claim 1, wherein said protrusion in said alignment assembly further comprises at least two tooling dowels rigidly fixed in said body plate.

3. A collapsible guitar assembly kit as recited in claim 1, wherein said corresponding opening in said alignment assembly further comprises at least two tooling openings, said openings defined in said neck plate, said openings sized and spaced to mate snugly with said dowels.

4. A collapsible guitar assembly kit as recited in claim 1, wherein said anchoring means for rigidly and releasably anchoring said neck to said body further comprises:

(a) a threaded fastener element;

(b) a backing plate, said backing plate rigidly mounted to said body plate with backing plate screws, said screws mating with threaded attachment bores defined in said body plate and attachment bores formed in said backing plate, said backing plate and said body plate arranged such that said backing plate and said body plate sandwich a portion of said body;

(c) a straight anchoring bore defined in said backing plate, said body, and said body plate; and (d) a threaded anchoring bore in said neck plate, threads on said threaded anchoring bore corresponding to threads on said threaded fastener element, said threaded anchoring bore aligned with said straight anchoring bore.

5. A collapsible guitar assembly kit as recited in claim 4, wherein said fastener element is a hex bolt.

6. A collapsible guitar assembly kit as recited in claim 4, wherein said backing plate is sized to correspond to said body plate such that said attachment bores and said straight bore formed in said backing plate can be used as a template for drilling holes in said body to correspond to said threaded attachment bores in said body plate, said attachment bores in said backing plate and said straight bore in said backing plate and said body plate.

7. A collapsible guitar assembly kit comprising:

(a) alignment means for aligning a guitar neck and a guitar body, said alignment means integrated with said neck and said body;

(b) said alignment means including at least one alignment protrusion and at least one corresponding alignment opening sized to mate snugly with said protrusion; and (c) anchoring means for releasably anchoring said neck to said body;

(d) wherein said protrusion in said body plate comprises at least two tooling dowels formed on said body plate, and said corresponding opening in said neck plate comprises at least two tooling openings corresponding to said dowels, said openings sized and spaced to mate snugly with said dowels.

8. A collapsible guitar assembly kit as recited in claim 7, wherein said alignment means further comprises:

(a) a neck plate, said neck plate rigidly mounted to said neck;

(b) a body plate, said body plate rigidly mounted to said body;

(c) at least one said protrusion formed in said body plate; and (d) at least one corresponding opening formed in said neck plate, said opening sized to mate snugly with said protrusion.

9. A collapsible guitar assembly kit as recited in claim 7, wherein said anchoring means further comprises:

(a) at least one threaded anchoring element;

(b) a backing plate, said backing plate rigidly mounted to said body plate with backing plate screws, said screws mating with threaded attachment bores defined in said body plate and attachment bores formed in said backing plate, said backing plate and said body plate arranged such that said backing plate and said body plate sandwich a portion of said body;

(c) a corresponding straight anchoring bore defined in said backing plate, said body, and said body plate; and (d) a threaded anchoring bore in said neck plate, said threaded anchoring bore including threads corresponding to threads on said threaded anchoring element, said threaded anchoring bore aligned with said straight anchoring bore.

10. A collapsible guitar assembly kit as recited in claim 9, wherein said anchoring element is a hex bolt.

11. A collapsible guitar assembly kit as recited in claim 7 further comprising templating means for laying out drill pattern in said guitar body.

12. A collapsible guitar assembly kit as recited in claim 11, wherein said templating means comprises said backing plate, said backing plate shaped to correspond to said body plate such that said attachment bores and said straight bore formed in said backing plate can be used as a template for drilling holes in said body to correspond to said threaded attachment bores in said body plate, said attachment bores in said backing plate and said straight bore in said backing plate and said body plate.

13. A collapsible guitar assembly kit as recited in claim 7, wherein said assembly kit further comprises tensioning means for stabilizing guitar strings during removal and installation of said neck and during storage of said neck when collapsed.

14. A collapsible guitar assembly kit as recited in claim 13, wherein said tensioning means comprises:

(a) at least two tension spools;

(b) at least two hardened straps, said spools attached to said hardened straps with strap pins, said pins having a first end and a second end; and (c) at least two elastic straps, said elastic straps including at least one aperture at each end, said apertures sized to mate with said pins, said elastic straps releasably engaging said first and said second ends of said pins, said elastic straps sized to maintain said spools against said guitar neck when said elastic straps are positioned around said neck and said elastic straps engage said ends of said pins.

15. A collapsible guitar assembly kit comprising:

(a) a neck plate, said neck plate rigidly mounted to the neck of a guitar, said neck plate including at least two tooling openings, said neck plate including at least one threaded bore;

(b) a body plate, said body plate rigidly mounted to the body of a guitar, said body plate including at least two tooling dowels, said dowels sized and spaced to mate snugly with said tooling openings, said body plate including at least one straight bore;

(c) a backing plate, said backing plate rigidly mounted to said body plate with backing plate screws, said screws mating with threaded attachment bores defined in said body plate and attachment bores formed in said backing plate, said backing plate and said body plate arranged such that said backing plate and said body plate sandwich a portion of said body;

(d) said backing plate shaped to correspond to said body plate such that said attachment bores and said straight bore formed in said backing plate can be used as a template for drilling holes in said body to correspond to said threaded attachment bores in said body plate, said attachment bores in said backing plate and said straight bore in said backing plate and said body plate;

(e) a threaded fastener, said fastener including a first threaded end and a second working end, said fastener sized to cooperate with said straight bores, said first threaded end sized to mate with said threaded bore in said neck plate such that when said dowels and tooling openings are aligned and interlaced, and when said fastener is inserted through said backing plate, said body, said body plate and into said threaded bore in said neck plate, said fastener provides clamping force necessary to maintain the proper rigidity between said neck and said body; and (f) a tension rack for stabilizing guitar strings during removal and installation of said neck and during storage of said neck when collapsed comprising two tension spools, two hardened straps, two strap pins, and two elastic straps;

(g) said spools attached to said hardened straps with said pins, said pins having a first end and a second end;

(h) said elastic straps including at least one aperture at each end, said apertures sized to mate with said pins, said elastic straps releasably engaging said first and said second ends of said pins, said elastic straps sized to maintain said spools against said guitar neck when said elastic straps are positioned around said neck and said elastic straps engage said ends of said pins.

16. A collapsible guitar assembly kit comprising:

(a) a neck plate, said neck plate rigidly attached to a guitar neck;

(b) a body plate, said body plate rigidly attached to a guitar body;

(c) an alignment assembly integrated with said neck plate and said body plate, said assembly including at least one protrusion and at least one corresponding opening sized to mate snugly with said protrusion; and (d) an assembly fastener, said fastener including anchoring means for rigidly and releasably anchoring said neck to said body;

(e) said protrusion in said alignment assembly further comprises at least two tooling dowels rigidly fixed in said body plate.

17. A collapsible guitar assembly kit comprising:

(a) a neck plate, said neck plate rigidly attached to a guitar neck;

(b) a body plate, said body plate rigidly attached to a guitar body;

(c) an alignment assembly integrated with said neck plate and said body plate, said assembly including at least one protrusion and at least one corresponding opening sized to mate snugly with said protrusion; and (d) an assembly fastener, said fastener including anchoring means for rigidly and releasably anchoring said neck to said body;

(e) wherein said corresponding opening in said alignment assembly further comprises at least two tooling openings, said openings defined in said neck plate, said openings sized and spaced to mate snugly with said protrusion.

18. A collapsible guitar assembly kit comprising:

(a) alignment means for aligning a guitar neck and a guitar body, said alignment means integrated with said neck and said body;

(b) said alignment means including at least one alignment protrusion and at least one corresponding alignment opening sized to mate snugly with said protrusion; and (c) anchoring means for releasably anchoring said neck to said body;

(d) at least two tension spools;

(e) at least two hardened straps, said spools attached to said hardened straps with strap pins, said pins having a first end and a second end; and (f) at least two elastic straps, said elastic straps including at least one aperture at each end, said apertures sized to mate with said pins, said elastic straps releasably engaging said first and said second ends of said pins, said elastic straps sized to maintain said spools against said guitar neck when said elastic straps are positioned around said neck and said elastic straps engage said ends of said pins.

* * * * *